US010763052B2

(12) United States Patent
Yokoyama

(10) Patent No.: US 10,763,052 B2
(45) Date of Patent: Sep. 1, 2020

(54) CONTACT MEMBER, CONTACT MEMBER PRODUCTION METHOD, AND PUSH-BUTTON SWITCH MEMBER EQUIPPED WITH CONTACT MEMBER

(71) Applicant: SHIN-ETSU POLYMER CO., LTD., Tokyo (JP)

(72) Inventor: Kazunobu Yokoyama, Nagano (JP)

(73) Assignee: SHIN-ETSU POLYMER CO., LTD., Tokyo (JP)

( * ) Notice: Subject to any disclaimer, the term of this patent is extended or adjusted under 35 U.S.C. 154(b) by 0 days.

(21) Appl. No.: 16/339,359

(22) PCT Filed: Oct. 2, 2017

(86) PCT No.: PCT/JP2017/035767
§ 371 (c)(1),
(2) Date: Apr. 4, 2019

(87) PCT Pub. No.: WO2018/066490
PCT Pub. Date: Apr. 12, 2018

(65) Prior Publication Data

US 2019/0287739 A1 Sep. 19, 2019

(30) Foreign Application Priority Data

Oct. 7, 2016 (JP) ..... 2016-198822

(51) Int. Cl.
*H01H 1/06* (2006.01)
*H01H 1/02* (2006.01)
(Continued)

(52) U.S. Cl.
CPC ..... *H01H 1/06* (2013.01); *H01H 1/02* (2013.01); *H01H 1/04* (2013.01); *H01H 11/04* (2013.01);
(Continued)

(58) Field of Classification Search
CPC .. H01H 1/06; H01H 1/02; H01H 1/04; H01H 11/04
(Continued)

(56) References Cited

U.S. PATENT DOCUMENTS

2011/0266129 A1* 11/2011 Inagaki ..... H01H 1/06 200/530
2016/0372276 A1* 12/2016 Han ..... H01H 11/04

FOREIGN PATENT DOCUMENTS

JP S62-54433 U 4/1987
JP H3-57828 6/1991
(Continued)

OTHER PUBLICATIONS

International Search Report in PCT/JP2017/035767, dated Dec. 19, 2017, 4pp.

*Primary Examiner* — Nguyen Tran
*Assistant Examiner* — Iman Malakooti
(74) *Attorney, Agent, or Firm* — Hauptman Ham, LLP

(57) ABSTRACT

In a contact member, a mesh-like contact including one or more layers of a metal other than a noble metal is embedded in such a manner as to be exposed from one of the surfaces of a rubbery elastic body. The contact member includes a highly conductive metal coat layer only in the regions of the mesh-like contact which are exposed from the rubbery elastic body, the coat layer having conductivity higher than that of the metal on the outermost surfaces of the mesh-like contact.

14 Claims, 10 Drawing Sheets

A-A LINE CROSS-SECTIONAL VIEW

(51) Int. Cl.

| | |
|---|---|
| ***H01H 11/04*** | (2006.01) |
| ***H01H 13/14*** | (2006.01) |
| ***H01H 1/04*** | (2006.01) |
| ***H01H 13/12*** | (2006.01) |

(52) U.S. Cl.
CPC ..... *H01H 13/12* (2013.01); *H01H 13/14* (2013.01); *H01H 2201/032* (2013.01)

(58) Field of Classification Search
USPC ..... 200/238
See application file for complete search history.

(56) References Cited

FOREIGN PATENT DOCUMENTS

| | | | |
|---|---|---|---|
| JP | H8-276435 | A | 10/1996 |
| JP | 2004-342539 | A | 12/2004 |
| JP | 2012-185956 | A | 9/2012 |
| JP | 2014-240058 | A | 12/2014 |

* cited by examiner

A-A LINE CROSS-SECTIONAL VIEW

B-B LINE CROSS-SECTIONAL VIEW

C-C LINE CROSS-SECTIONAL VIEW

Fig. 9A

| | | ELECTROLESS GOLD PLATING | ELECTROLYTIC GOLD PLATING |
|---|---|---|---|
| SURFACE PREPARATION CONDITION | | ALKALI DEGREASING, ACID TREATMENT | ← |
| PLATING TREATMENT | TYPE OF FLUID | CYANOGEN BATH (NEUTRAL BATH) | ← |
| | pH | 6-7 | ← |
| | TEMPERATURE | 1 | 1/2 |
| | TIME | 1 | 1/10 |

Fig. 9B

| | | ELECTROLESS GOLD PLATING | ELECTROLYTIC GOLD PLATING |
|---|---|---|---|
| CONTACTNESS OF METAL WITH Au PLATING TAPE SEPARATION TEST | | NO SEPARATION | NO SEPARATION |
| ADHESIVENESS OF SILICONE RUBBER TO METAL WIRE | FORCED SEPARATION TEST BY PINCHING WIRE MESH PORTION | WIRE MESH INTERFACE SEPARATION | AGGREGATION BREAKAGE AT RUBBER PORTION |
| | EXISTENCE OF SEPARATION OF METAL BARS GENERATED AT END PORTION IN 3 MM DIAMETER PUNCHING | YES | NO |

Fig. 9C

| | | NO GOLD PLATING | GOLD PLATED (ELECTROLESS PLATING) | GOLD PLATED (ELECTROLYTIC PLATING) |
|---|---|---|---|---|
| CONTACT RESISTANCE (Ω) | Max. | 0.440 | 0.295 | 0.301 |
| | Min. | 0.244 | 0.214 | 0.214 |
| | Av. | 0.338 | 0.224 | 0.239 |

Fig. 10A
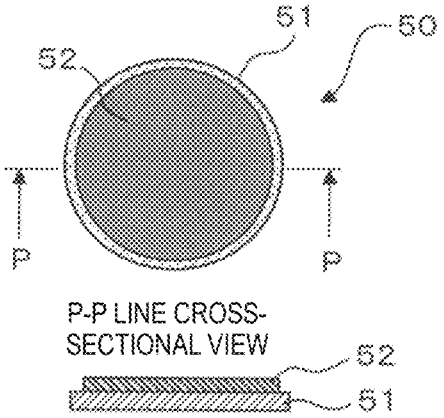
Fig. 10B
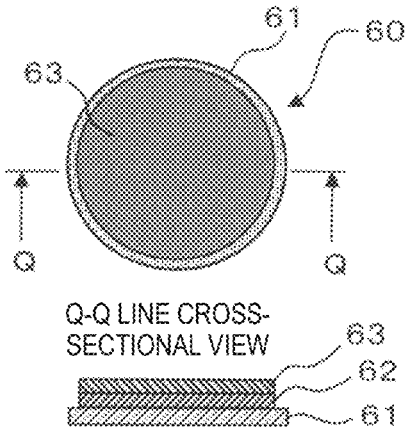
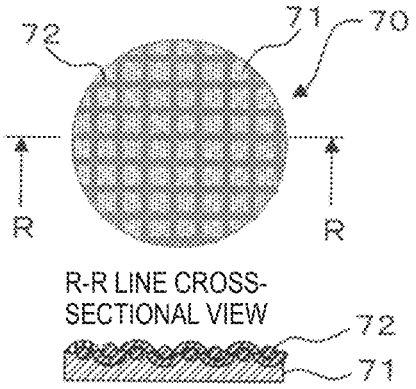
Fig. 10C
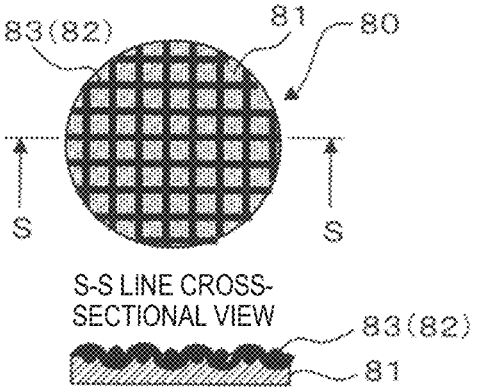
Fig. 10D

CONTACT MEMBER, CONTACT MEMBER PRODUCTION METHOD, AND PUSH-BUTTON SWITCH MEMBER EQUIPPED WITH CONTACT MEMBER

RELATED APPLICATION(S)

The present application is a National Phase of International Application Number PCT/JP2017/035767, filed Oct. 2, 2017, which claims the benefit of priority from Japanese Patent Application No. 2016-198822 filed on Oct. 7, 2016, the contents of which are incorporated herein by reference. Additionally, the contents described in the patents, patent applications and literatures cited in this patent application are also incorporated herein by reference.

TECHNICAL FIELD

The present invention relates to a contact member, a contact member production method, and a push-button switch member equipped with the contact member.

BACKGROUND ART

In relation to push-button switch members, as a contact member that can elastically move into contact with and move apart from a contact on a circuit board, there is conventionally known a contact member in which a thin metal plate or a plated metal plate is affixed to a silicone rubber. As contact members of other forms, there are also conventionally known a contact member in which holes are opened in a thin metal plate, a contact member in which a wire mesh is affixed to a silicone rubber, and a contact member in which the wire mesh is covered with a different type of metal (refer to Patent Literatures 1 to 4).

FIG. 10A to 10D illustrate plan views and cross-sectional views (10A, 10B, 10C, 10D) of conventionally known contact members. A contact member 50 illustrated in FIG. 10A has a configuration where a metal plate 52 made of nickel, SUS or the like is affixed to one surface of a disc-shaped silicone rubber 51, as illustrated in a cross-sectional view taken along a line P-P. A contact member 60 illustrated in FIG. 10B has a configuration where a metal plate 62 made of nickel, SUS or the like is affixed to one surface of a disc-shaped silicone rubber 61, and a coat layer 63 of gold or the like is provided on a surface of the metal plate 62, as illustrated in a cross-sectional view taken along a line Q-Q. A contact member 70 illustrated in FIG. 10C has a configuration where a mesh (wire mesh) 72 of a metal such as nickel, SUS or the like is affixed to one surface of a disc-shaped silicone rubber 71, as illustrated in a cross-sectional view taken along a line R-R. A contact member 80 illustrated in FIG. 10D has a configuration where a wire mesh 82 coated with gold or the like in advance is affixed to one surface of a disc-shaped silicone rubber 81, as illustrated in a cross-sectional view taken along a line S-S. A coat layer 83 covers almost the whole surface of the wire mesh 82.

The contact members 50, 60 illustrated in FIGS. 10A and 10B, respectively, have a low resistance and a superior electrical conductance. In the contact members 50, 60, however, a surface brought into contact with a contact on a circuit board is flat, resulting in a problem in that the contact between the surface and the contact on the circuit board is easily affected by foreign matters interposed therebetween. To solve this problem, as with the contact members 70, 80 illustrated in FIGS. 10C and 10D, an approach is adopted in which a surface brought into contact with a contact on a circuit board is made up of a wire mesh like the wire meshes 72, 82 to form an irregular surface that can still come into contact with the contact on the circuit board even though foreign matters are interposed therebetween. Additionally, there is also known an approach where a metal plate including holes is used in place of the wire mesh like the wire meshes 72, 82.

CITATION LISTS

Patent Literatures

Patent Literature 1: Japanese Utility Model Laid-Open No. 62-054433

Patent Literature 2: Japanese Patent Laid-Open No. 2004-342539

Patent Literature 3: Japanese Patent Laid-Open No. 2012-185956

Patent Literature 4: Japanese Patent Laid-Open No. 2014-240058

SUMMARY OF INVENTION

Technical Problem

However, the following are required on the conventionally known contact members and push-button switch members provided with these contact members. A first requirement is not only to realize a high corrosion resistance by reducing the exposure of the metal such as nickel, SUS or the like but also to enhance the reliability of a contact by preventing the contact member from malfunctioning while in use. A second requirement is to realize a low cost by preventing holes from being made when punching or etching is performed and reducing an amount of coating metal to be used.

An object of the present invention is to meet the above requirements, that is, to provide a highly reliable and low-cost contact member and a push-button switch member including the contact member.

Solution to Problem

The inventor has made every effort to achieve the object, as a result of which a contact member has been completed in which part of a meshed contact represented by a wire mesh is embedded in a rubber, and a highly conductive metal different in type from the meshed contact is coated on the meshed contact exposed from the rubber with a bonding interface between the rubber and the meshed contact left as it is. A specific solution of the present invention to the problem described above is as follows.

With a view to achieving the object, according to an embodiment, there is provided a contact member including a meshed contact including one or more layers of a metal other than a noble metal, the meshed contact being embedded in one surface of a rubber-like elastic body in such a manner as to be exposed, in which a highly conductive metal coat layer having a higher conductivity than that of the metal in an outermost surface of the meshed contact is provided only on a region of the meshed contact exposed from the rubber-like elastic body.

In a contact member according to another embodiment, the meshed contact may be a wire mesh comprising a plurality of metal wires intersecting each other, and the wire mesh may be embedded in the rubber-like elastic body with at least the metal wires in one direction of the metal wires making up the wire mesh exposed.

In a contact member according to a further embodiment, the wire mesh may be formed by interlacing the metal wires in two directions, the metal wires in the two directions may be embedded in the rubber-like elastic body with both the metal wires in the two directions exposed, and the metal wires in either of the two directions may be covered with the coat layer over a wider area than an area where the metal wires in the other of the two directions are covered with the coat layer in a plan view.

In a contact member according to another embodiment, the wire mesh may be formed by interlacing the metal wires in two directions, the metal wires in the two directions may be embedded in the rubber-like elastic body with both the metal wires in the two directions exposed, and a number of points where the metal wires in either of the two directions are exposed from the rubber-like elastic body may be greater than a number of points where the metal wires in the other of the two directions are exposed from the rubber-like elastic body.

In a contact member according to another embodiment, the wire mesh may be formed by interlacing the metal wires in two directions, the metal wires in the two directions may be embedded in the rubber-like elastic body with both the metal wires in the two directions exposed, and a height in which the metal wires are exposed from the rubber-like elastic body may be smaller than a diameter of the metal wires so exposed.

In a contact member according to a further embodiment, the coat layer may be an electrolytic plating layer.

In a contact member according to another embodiment, one or a plurality of projecting portions may be provided on a surface of a side of the rubber-like elastic body, the side being opposite to the side where the meshed contact is exposed.

In a contact member according to another embodiment, a surface of each of the projecting portions may be a curved surface.

With a view to achieving the object, according to an embodiment, there is provided a contact member production method for producing the contact member of any one of the contact members described above, including a meshed contact portion embedding step of embedding a meshed contact including one or more layers of a metal other than a noble metal in a curable rubber composition that is in a stage before a rubber-like elastic body is cured completely in such a manner that the meshed contact is exposed, a curing step of curing the curable rubber composition following the meshed contact portion embedding step, and a plating layer forming step of forming a highly conductive metal coat layer having a higher conductivity than that of the metal in an outermost surface of the meshed contact only on a region of the meshed contact exposed from the rubber-like elastic body.

With a view to achieving the object, according to an embodiment, there is provided a push-button switch member including any one of the contact members described above.

Advantageous Effects of Invention

According to the present invention, it is possible to provide the highly reliable and low-cost contact member and the push-button switch member including the contact member.

BRIEF DESCRIPTION OF DRAWINGS

FIGS. 2A and 2B illustrate a first embodiment of a contact member connected to the push-button switch member in FIG. 1, in which FIG. 2A illustrates a surface opposite to a substrate side contact of the contact member, and FIG. 2B is a cross-sectional view taken along a line A-A in FIG. 2A.

FIGS. 4A and 4B illustrate a second embodiment of a contact member connected to the push-button switch member in FIG. 1, in which FIG. 4A illustrates a surface opposite to a substrate side contact of the contact member, and FIG. 4B is a cross-sectional view taken along a line B-B in FIG. 4A.

FIGS. 5A and 5B illustrate a third embodiment of a contact member connected to the push-button switch member in FIG. 1, in which FIG. 5A illustrates a surface opposite to a meshed contact of the contact member, and FIG. 5B is a cross-sectional view taken along a line C-C in FIG. 5A.

FIG. 9A to 9C illustrate comparisons between an electroless plating of gold and an electrolytic plating of gold in relation to production condition and performance, in which FIG. 9A illustrates a comparison in relation to production condition, FIG. 9B illustrates comparisons in relation to a contact force of a plating layer and a bonding force between a meshed contact and a rubber-like elastic body, and FIG. 9C illustrates a comparison in relation to a contact resistance value.

FIG. 10A to 10D illustrate plan views and cross-sectional views (FIGS. 10A, 10B, 10C, 10D) of conventionally known contact members.

DESCRIPTION OF EMBODIMENTS

Next, preferred embodiments of the present invention will be described by reference to drawings. Note that embodiments that will be described below do not limit inventions according to claims and that all elements and combinations thereof that will be described in the following embodiments are not necessarily essential to a solution to the problem of the present invention.

1. Push-Button Switch Member

Figure 1:
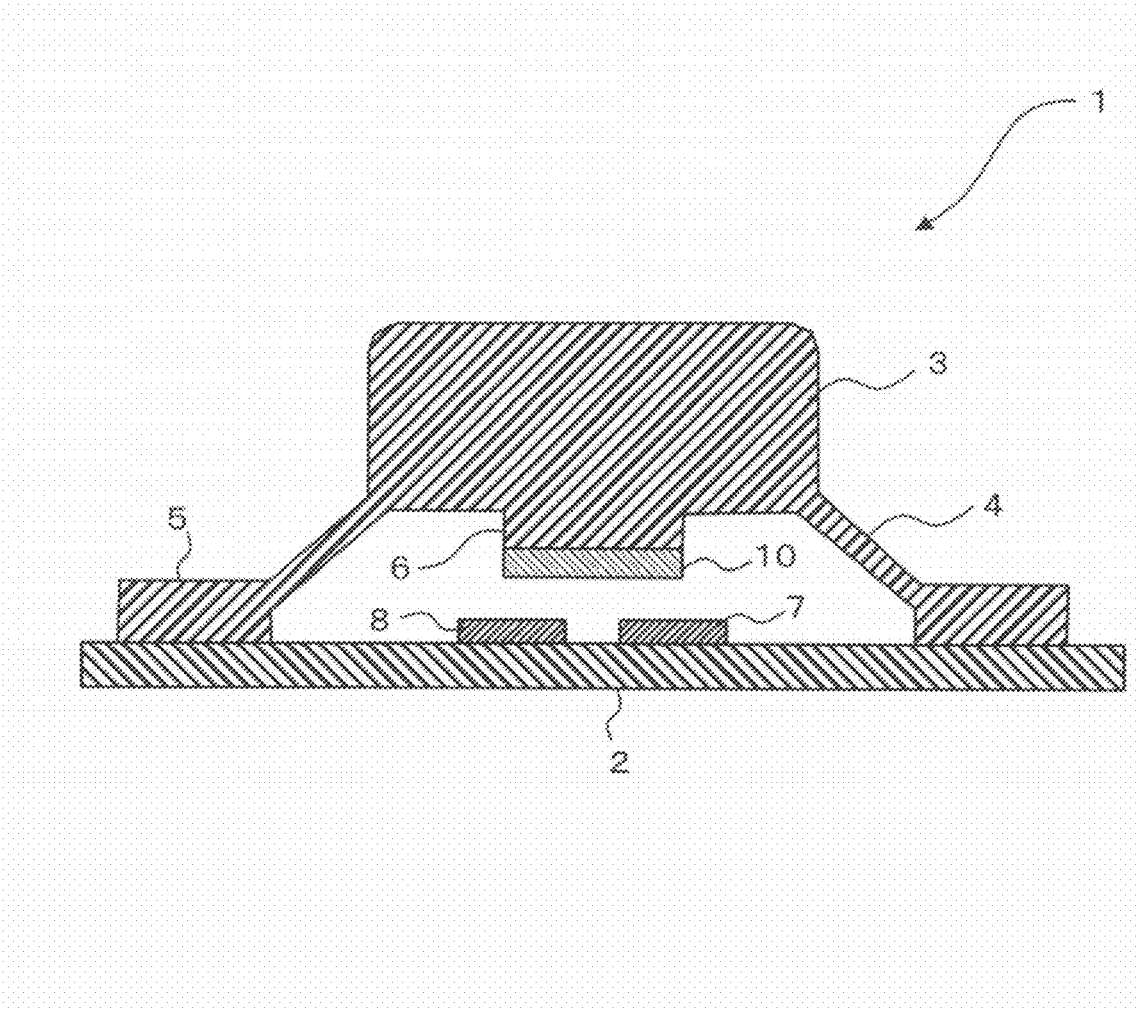
FIG. 1 is a vertical sectional view illustrating a state where a push-button switch member according to an embodiment of the present invention is disposed on a circuit board.

FIG. 1 is a vertical sectional view illustrating a state where a push-button switch member according an embodiment of the invention is disposed on a circuit board.

As illustrated in FIG. 1, a push-button switch member 1 is disposed on a circuit board 2 and reciprocates elastically in a direction of the circuit board 2 (a downward direction in FIG. 1) and an opposite direction thereto (an upward direction in FIG. 1). The push-button switch member 1 preferably includes a key top 3 having a substantially rectangular parallelepiped shape or a substantially cylindrical shape, a dome portion 4 connected to a radially outer side of the key top 3 into a skirt-like shape, and a flange portion 5 connected to a radially outer side of the dome portion 4 and fixed to the circuit board 2. The key top 3 includes a lower projecting portion 6 provided on a lower surface of the key top 3 facing the circuit board 2 in such a manner as to project in the direction of the circuit board 2. The circuit board 2 includes a plurality of circuit board side contacts 7, 8, which are not in contact with each other, in a position facing the lower projecting portion 6. On the other hand, a contact member 10 including a portion formed of a conductive material is connected to the lower projecting portion 6 in a position where the contact member 10 is allowed to come into contact with the circuit board side contacts 7, 8.

When the key top 3 is not pressed down from above, the contact member 10 and the circuit board side contacts 7, 8 are held in a non-contact state. When the key top 3 continues to be pressed down from above and the pressure exceeds a certain threshold, the dome portion 4 drastically deforms (buckles), whereby the contact member 10 comes into contact with the circuit board side contacts 7, 8. A conductive path is formed from the circuit board side contact 7 to the circuit board side contact 8 by way of the contact member 10 by the contact of the contact member 10 with the circuit board side contacts 7, 8, whereby a switch is on (or off). When the pressure is released from the key top 3, the dome portion 4 restores its original shape by virtue of its own elastic force, whereby the key top 3 rises. As a result, the contact member 10 separates from the circuit board side contacts 7, 8.

In this embodiment, the push-button switch member 1 is formed into an integral unit from a rubber material. However, the push-button switch member 1 does not have to be formed into the integral unit from the rubber material, and hence, the push-button switch member 1 may be formed from any other material, provided that only at least the dome portion 4 is formed from a rubber material. Thermosetting elastomer such as silicone rubber, urethane rubber, isoprene rubber, ethylene propylene rubber, natural rubber, ethylene-propylene-diene rubber, nitrile rubber (NBR), or styrene-butadiene rubber (SBR); thermoplastic elastomer such as urethane-based, ester-based, styrene-based, olefin-based, butadiene-based, or fluorine-based elastomer; or combinations thereof are preferably used as a rubber material from which the push-button switch member 1 is formed. Silicone rubber is particularly preferable among the candidates described above.

2. Contact Member

2.1 First Embodiment

Figure 2A:
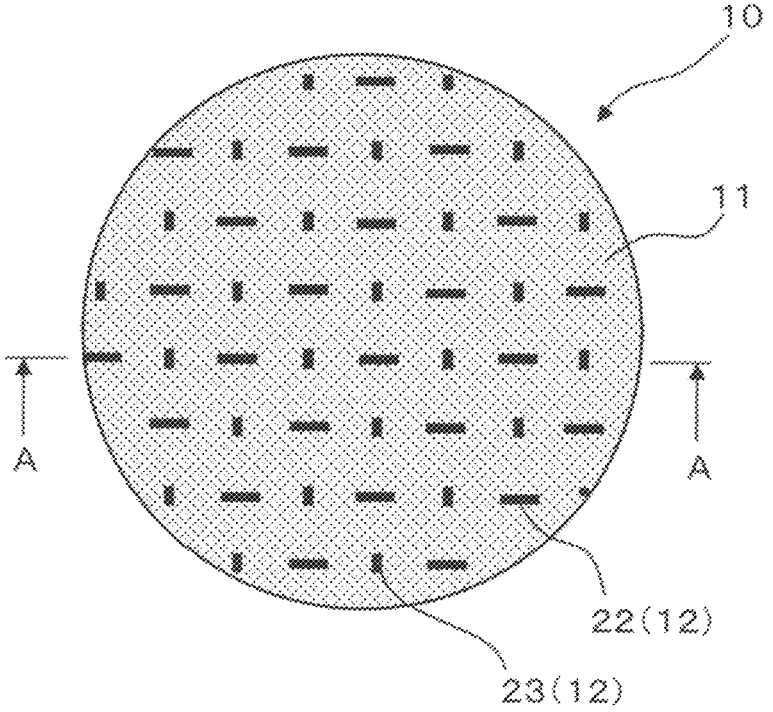
Figure 2B:
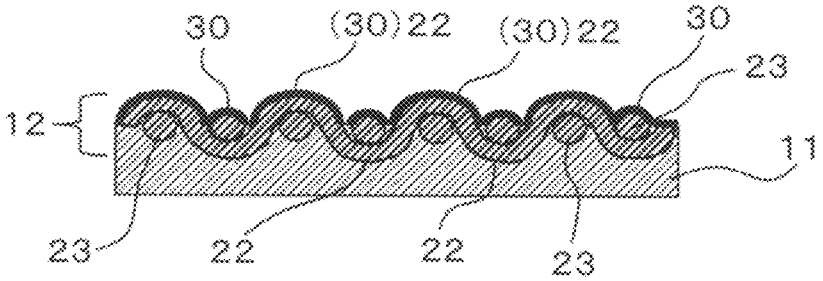

FIGS. 2A and 2B illustrate a first embodiment of a contact member configured to be connected to the push-button switch member illustrated in FIG. 1, in which FIG. 2A illustrates a surface of the contact member facing the circuit board side contacts, and FIG. 2B illustrates a cross-sectional view taken along a line A-A in FIG. 2A.

The contact member 10 illustrated in FIGS. 2A and 2B include a substantially disc-shaped rubber-like elastic body 11 and a meshed contact 12. In the contact member 10, the meshed contact 12 is made up of one or more layers of a metal other than a noble metal and is embedded in one surface of the rubber-like elastic body 11 in such a manner as to be exposed. The meshed contact 12 includes a plating layer 30, constituting one example of a coat layer of a highly conductive metal having a higher conductivity than that of the metal in an outermost surface of the meshed contact 12, only on a region of the meshed contact 12 that is exposed from the rubber-like elastic body. Hereinafter, in this embodiment and embodiments that will be described later, a plating layer and a form using plating will be described as an example of a coat layer and a coat. In a cross-sectional view in FIG. 2B, which is taken along a line A-A in FIG. 2A, portions on metal wires 22, 23 that are indicated by solid lines constitute plating layers 30. A plating layer 30 may be formed on the whole of portions of the meshed contact 12 that are exposed from the rubber-like elastic body 11 or may be formed on part of the exposed portions. No plating layer 30 is formed on portions of the meshed contact 12 that are embedded in the rubber-like elastic body 11. However, a plating layer 30 is different from a plating layer on an outermost surface of the meshed contact 12 when the meshed contact 12 is made up of two or more layers. For example, in the case where the meshed contact 12 includes a plating layer of nickel formed on surfaces of metal wires of copper, portions of the meshed contact 12 that are embedded in the rubber-like elastic body 11 have a layer structure of nickel and copper or a nickel-copper layer structure, while portions of the meshed contact 12 that are exposed from the rubber-like elastic body 11 have a layer structure of a plating layer 30 of gold or the like, nickel and copper or a plating layer 30-nickel-copper layer structure. As a further example, in the case where the meshed contact 12 is made up of metal wires of copper, portions of the meshed contact 12 embedded in the rubber-like elastic body 11 have copper only, while portions of the meshed contact 12 exposed from the rubber-like elastic body 11 may include a plating layer of nickel and a plating layer 30 of gold or the like formed on the nickel plating layer.

In this embodiment, the meshed contact 12 is a wire mesh made up of a plurality of metal wires 22, 23 intersecting each other. The wire mesh is preferably formed by interlacing a plurality of metal wires 22, 23, and is embedded in the rubber-like elastic body 11 in such a manner that in the metal wires 22, 23 that make up the wire mesh, at least the metal wires 22 in one direction (and/or the metal wires 23) are exposed. Note that the meshed contact 12 is not limited to the wire mesh and hence may be a plate having a plurality of holes or an integral structure having a mesh-like form. The meshed contact 12 is preferably attached directly to the rubber-like elastic body 11 without involving an adhesive layer on the rubber-like elastic body 11. Involving no adhesive layer or the like can reduce a risk of separation of the meshed contact 12 from the rubber-like elastic body 11, thereby making it possible to enhance more the quality of the push-button switch member 1. Omitting a step of forming an adhesive layer can also reduce the production cost of the push-button switch member 1.

The meshed contact 12 is preferably made up of metal wires 22, 23 in two directions that intersect each other and is embedded in the rubber-like elastic body 11 in such a manner that in the metal wires 22, 23 in the two directions, at least the metal wires 22 (or 23) in one direction are exposed. More preferably, the meshed contact 12 is embedded in the rubber-like elastic body 11 in such a manner that both the metal wires 22, 23 in the two directions are exposed, and either of the metal wires 22, 23 or the metal wires 22 are covered with the plating layer 30 over a wider area than an area where the other of the metal wires 22, 23 or the metal wires 23 are covered with the plating layer 30.

The meshed contact 12 (that may be referred to as a wire mesh) is formed by interlacing the metal wires 22, 23 in the two directions and is embedded in the rubber-like elastic body 11 in such a manner that both the metal wires 22, 23 in the two directions are exposed. Then, a number of points where either of the metal wires 22, 23 or the metal wires 22 are exposed from the rubber-like elastic body 11 can be made greater than a number of points where the other of the metal wires 22, 23 or the metal wires 23 are exposed from the rubber-like elastic body 11. Additionally, a height in which the metal wires 22, 23 are exposed from the rubber-like elastic body 11 can be made smaller than a diameter of the exposed metal wires 22, 23. This will be described in detail below.

The meshed contact 12 is formed by interlacing pluralities of metal wires 22, 23. The metal wires 22, 23 may have the same diameters or different diameters. A wire mesh formed using plain weave, twill weave or plain Dutch weave can be raised as an example of a preferred meshed contact 12. When referred to in this application, "to intersect" is construed as including not only a positional relationship in which metal wires intersect at right angles but also a positional relationship in which metal wires intersect at any other angle than right angles.

As illustrated in FIGS. 2A and 2B, in the meshed contact 12 according to the first embodiment, the metal wires 22 extending in a left-and-right direction in FIG. 2A project more in the direction of a surface of a sheet of paper on which FIGS. 2A and 2B are drawn than the metal wires 23 extending in an up-and-down direction in FIG. 2A. Due to this, the plating layer 30 covers surfaces of the metal wires 22 over a wider area than an area where the plating layer 30 covers surfaces of the metal wires 23 in a plan view, that is, as viewed from the direction of the surface of the sheet of paper on which FIGS. 2A and 2B are drawn (this state being referred to as a "covering state X3"). When the meshed contact 12 is embedded deeper into the rubber-like elastic body 11 than the state illustrated in FIGS. 2A and 2B, only the surfaces of the metal wires 22 are covered with the plating layer 30, and the surfaces of the metal wires 23 are not covered with the plating layer (refer to FIGS. 4A and 4B, which will be described later, and a description that will be made by reference to the figure, this state being referred to as a "covering state X2"). When the meshed contact 12 is embedded much deeper into the rubber-like elastic body 11, neither the metal wires 22 nor the metal wires 23 are covered with the plating layer 30 (this state being referred to as a "covering state X1"). On the other hand, when the meshed contact 12 is embedded less deep than the covering state X3 so that the meshed contact 12 is exposed on the rubber-like elastic body 11, the covering area of the metal wires 23 with the plating layer 30 approaches the covering area of the metal wires 22 with the plating layer 30 (this state being referred to as a "covering state X4"). When the meshed contact 12 is exposed more from the rubber-like elastic body 11 than the covering state X4, the covering area of the metal wires 22 with the plating layer 30 eventually becomes almost the same as the covering area of the metal wires 23 with the plating layer 30 (this state being referred to as a "covering state X5").

As the covering state advances from X5 towards X1, the meshed contact 12 moves further in the direction in which the meshed contact 12 is embedded into the rubber-like elastic body 11. As a result, a bonding force between the meshed contact 12 and the rubber-like elastic body 11 becomes stronger. However, the covering area by the plating layer 30 becomes smaller, whereby the function of the meshed contact 12 as an electric contact is reduced. On the contrary, as the covering state advances from X1 to X5, the meshed contact 12 moves further in a direction in which the meshed contact 12 is exposed on the rubber-like elastic body 11. As a result, the bonding force between the meshed contact 12 and the rubber-like elastic body 11 becomes weaker. However, the covering area by the plating layer 30 becomes greater, whereby the function of the meshed contact 12 as the electric contact is increased.

To enhance the bonding force between the meshed contact 12 and the rubber-like elastic body 11 and allow the meshed contact 12 to exhibit its high functionality as the electric contact, the meshed contact 12 is preferably embedded in the rubber-like elastic body 11 in such a manner as to produce a state where the plating layer 30 covers at least either of the metal wires 22 and the metal wires 23 and the covering areas of the metal wires 22 and the metal wires 23 differ from each other (the covering states X2 to X4). The meshed contact 12 is more preferably embedded in the rubber-like elastic body 11 in such a manner as to produce a state where the plating layer 30 covers both the metal wires 22 and the metal wires 23 and the covering areas of the metal wires 22 and the metal wires 23 differ from each other (the covering states X3 and X4).

When attempting to enhance the bonding force between the meshed contact 12 and the rubber-like elastic body 11 and allow the meshed contact 12 to exhibit its high functionality as the electric contact from a different point of view, a ratio of the number of apexes of the metal wires 22 where the metal wires 22 project from the rubber-like elastic body 11 to the number of apexes of the metal wires 23 where the metal wires 23 project from the rubber-like elastic body 11 can be raised. Assuming that of the metal wires 22 and the metal wires 23, one smaller number of apexes is referred to as P1, while the other number of apexes is referred to as P2, 100(%)×P1/P2 is preferably 10% or greater and 90% or smaller, is more preferably 20% or greater and 70% or smaller, and is much more preferably 30% or greater and 50% or smaller. With 100(%)×P1/P2 set to fall within these ranges, the bonding force can be ensured as a result of an increase in the bonding area between the rubber-like elastic body 11 and the metal wires 22, 23 and an increase in the fitting effect, and the reliability can be ensured by an increase in the number of covering portions by the plating layer 30 that are brought into contact with the circuit board side contacts 7, 8. In addition to theses, the extent of the plating layer 30 covering the projecting portions of the metal wires 22, 23 does not have to be increased excessively, thereby making it possible to realize a reduction in production costs.

Figure 3A:
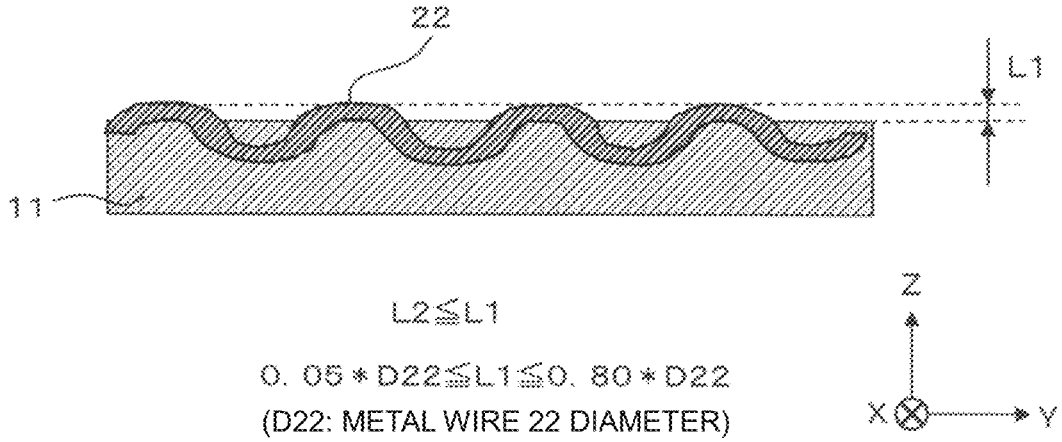
FIGS. 3A and 3B illustrate a cross-sectional view (FIG. 3A) of only a metal wire in one direction making up a meshed contact in FIGS. 2A and 2B and a cross-sectional view (FIG. 3B) of only a metal wire in the other direction.
Figure 3B:
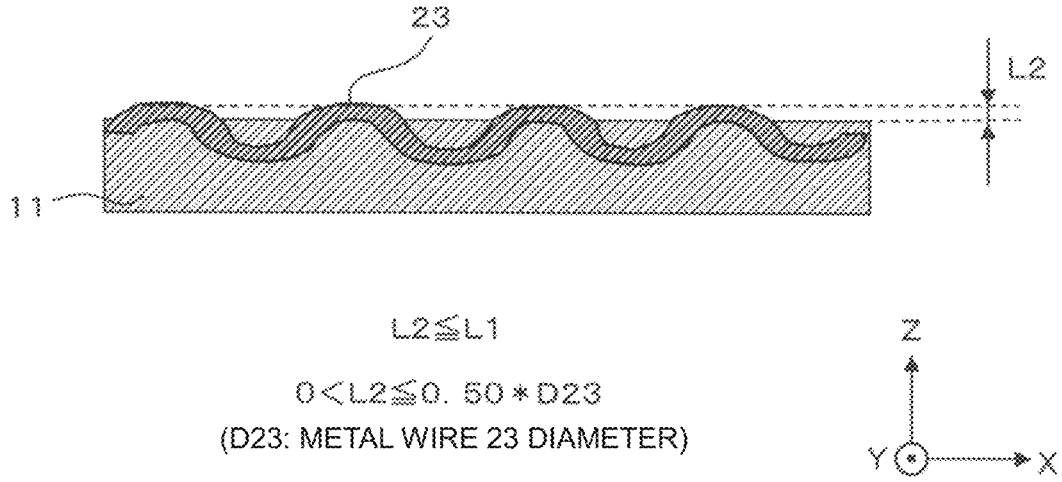

FIGS. 3A and 3B illustrate a sectional view (3A) illustrating only the metal wires in one direction and a sectional view (3B) illustrating only the metal wires in the other direction, both the metal wires making up the meshed contact illustrated in FIGS. 2A and 2B. Thus, in FIG. 3A, the metal wires 23 interlaced together with the metal wires 22 are not illustrated. Similarly, in FIG. 3B, the metal wires 22 interlaced together with the metal wires 23 are not illustrated. Additionally, an X direction, a Y direction, and a Z direction are shown only in FIGS. 3A and 3B to clearly show a length direction of the metal wires 22 and the metal wires 23.

In place of or in addition to the view points of the covering areas of the metal wires 22 and the metal wires 23 covered by the plating layer 30 and the numbers of exposed apexes of the metal wires 22 and the metal wires 23, the balance between the function to enhance the bonding force between the meshed contact 12 and the rubber-like elastic body 11 and the function to allow the meshed contact 12 to exhibit its high performance as the electric contact can be controlled based on exposed heights of the metal wires 22 and the metal wires 23 as below. As illustrated in FIGS. 3A and 3B, in this embodiment, a height (L1) in which the metal wires 22 are exposed on the rubber-like elastic body 11 is the same as or slightly greater than a height (L2) in which the metal wires 23 are exposed on the rubber-like elastic body 11 (L2≤L1). L1 is preferably 5% or greater and 80% or smaller a diameter (D22) of the metal wire 22 and is more preferably 20% or greater and 60% or smaller. L2 is preferably greater than 0% and 50% or smaller a diameter (D23) of the metal wire 23 and is more preferably 3% or greater and 30% or smaller. L2 may be 0% of the diameter (D23) of the metal wire 23, that is, the metal wires 23 may not be exposed from the rubber-like elastic body 11.

The metal wires 22, 23 should be formed of a conductive metal other than a noble metal whether the metal wires 22, 23 are formed of the same material or different materials. For example, the metal wires 22, 23 are preferably formed of any one of nickel (Ni), copper (Cu), tungsten (W), and stainless steel (SUS) or an alloy of any two or more metals selected from them. When referred to herein, the noble metal denotes one or some of gold (Au), platinum (Pt), silver (Ag), palladium (Pd), rhodium (Rh), iridium (Ir), ruthenium (Ru) or osmium (Os). The plating layer 30 is preferably formed of one or some of, for example, gold (Au), silver (Ag), nickel (Ni), palladium (Pd), tungsten (W), molybdenum (Mo), and copper (Cu) on the premise that the plating layer 30 is formed of a metal differing from the metal wires 22, 23 and a highly conductive metal having superior conductivity to that of the metal wires 22, 23. A preferred metal making up the plating layer 30 is a noble metal. In the case where electrolytic plating is used as a method of forming the plating layer 30, which will be described later, the metal forming the plating layer 30 needs to be ionized less than the metal making up the metal wires 22, 23. The plating layer 30 is preferably formed through electrolytic plating or electroless plating, and the plating layer 30 is more preferably formed through electrolytic plating. The electrolytic plating and the electroless plating will be described in detail later. A wire mesh formed by interlacing metal wires 22, 23 formed by applying a nickel layer around a copper core can be raised as a preferred example of the meshed contact 12. As an example of a form of the meshed contact 12, a plating layer 30 of gold is formed only on regions of the meshed contact 12 where the meshed contact 12 is exposed on the rubber-like elastic body 11.

2.2 Second Embodiment

Figure 4A:
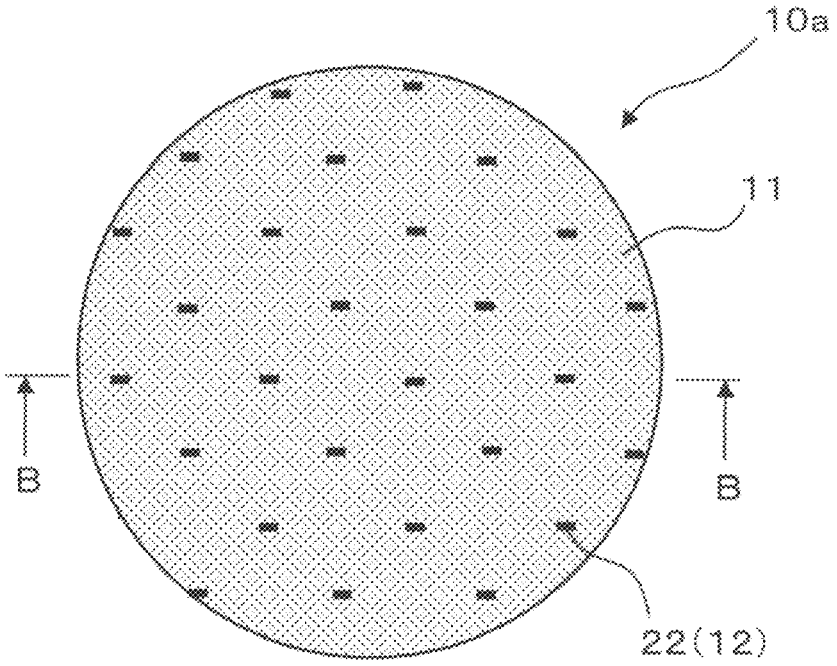
Figure 4B:
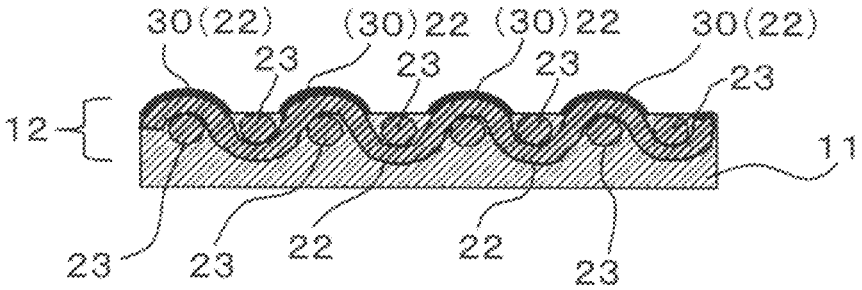

FIGS. 4A and 4B illustrate a second embodiment of a contact member that is connected to the push-button switch member illustrated in FIG. 1, in which FIG. 4A illustrates a surface of the contact member that faces the circuit board side contacts, and FIG. 4B illustrates a cross-sectional view taken along a line B-B in FIG. 4A.

In a contact member 10*a* according to the second embodiment, like reference signs will be given to like configurations to those of the contact member 10 according to the first embodiment, so that descriptions thereof will be omitted here based on the understanding that the descriptions are replaced by the similar descriptions made in the first embodiment.

In the contact member 10*a* according to the second embodiment, a meshed contact 12 is embedded deeper into a rubber-like elastic body 11 than in the first embodiment. Due to this, a plating layer 30 is coated only on metal wires 22 making up the meshed contact 12. In a cross-sectional view taken along a line B-B in FIG. 4B, portions on the metal wires 22 indicated by solid lines are covered with the plating layer 30. Metal wires 23 are not covered with the plating layer 30 since the metal wires 23 are embedded in the rubber-like elastic body 11 completely. The structure and material of the contact member 10*a* of the second embodiment other than the configuration described above remain common to the first embodiment. The covering state of this embodiment described above corresponds to the "covering state X2" described above in relation to the first embodiment.

2.3 Third Embodiment

Figure 5A:
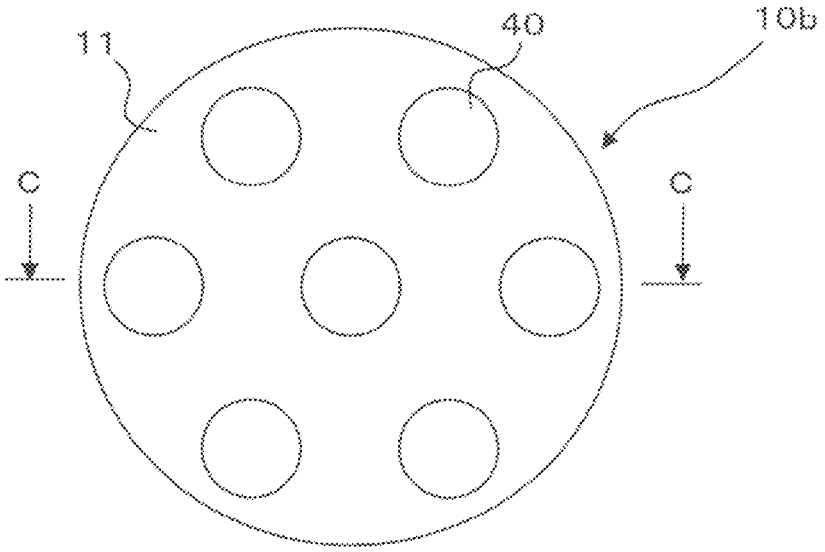
Figure 5B:
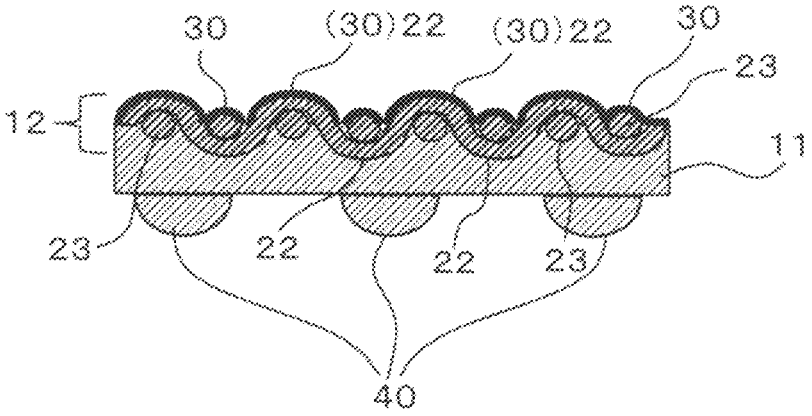

FIGS. 5A and 5B illustrate a third embodiment of a contact member that is connected to the push-button switch member illustrated in FIG. 1, in which FIG. 5A illustrates a surface of a side of the contact member opposite to a side where a meshed contact is formed, and FIG. 5B illustrates a cross-sectional view taken along a line C-C in FIG. 5A.

In a contact member 10*b* according to the third embodiment, like reference signs will be given to like configurations to those of the contact members 10, 10*a* of the first and second embodiments, so that descriptions thereof will be omitted here based on the understanding that the descriptions are replaced by the similar descriptions made in the first and second embodiments.

The contact member 10*b* according to the third embodiment is like to the contact member 10 according to the first embodiment except that a plurality of projecting portions 40 are provided on a side of a rubber-like elastic body 11 opposite to a side where a meshed contact 12 is formed. In a cross-sectional view taken along a line C-C in FIG. 5B, portions on metal wires 22 and metal wires 23 indicated by solid lines are covered with a plating layer 30. In this embodiment, the projecting portions 40 preferably have a curved surface. The projecting portions 40 have a function to prevent a surface of the side of the contact member 10*b* opposite to the side where the meshed contact 12 is formed from being affixed to another contact member 10*b*. Without the projecting portions 40, the surface of the side of the contact member 10*b* opposite to the side where the meshed contact 12 is formed is affixed to a side of another contact member 10*b* where a meshed contact 12 is formed or a side opposite thereto, resulting in a possibility that the two contact members 10*b*, 10*b* are hardly separated from each other in an easy fashion. As a result, there is caused a risk of a push-button switch member 1 in which two contact members 10*b*, 10*b* are left superposed on each other being produced. Thereafter, when one of the two contact members 10*b*, 10*b* comes off, there is caused a drawback in that a stroke (a distance when a key top 3 is depressed) is increased by the thickness of one contact member 10*b*. Since the projecting portions 40 have the function to prevent the affixation of contact members described above, the possibility of the occurrence of the aforesaid drawback is reduced.

In addition, the state of the surface of the contact member 10*b* where the projecting portions 40 are formed can be differentiated from the state of the surface thereof where the meshed contact 12 is formed, and hence, in disposing the contact member 10*b* in an interior of a forming mold, it is possible to reduce a risk of the contact member 10*b* being disposed in the interior of the forming mold with an opposite surface to a proper layered surface thereof erroneously oriented upwards.

Forming the projecting portions 40 enhances the reliability of the push-button switch member 1 including the contact member 10*b* and contributes to a reduction in production cost due to the following reason. As another method for preventing the affixation of the contact members 10*b*, a method is also considered in which ultraviolet ray is shone onto a surface of a contact member 10*b* where projecting portions 40 are formed to reduce tackiness. However, including the step of shining ultraviolet ray in the production process contradicts the attempt to reduce the production cost of the contact member 10*b*. Forming projecting portions 40 in the process of molding a contact member 10*b* results in a lower production cost, compared with a case where the ultraviolet ray shining step is included in the production process.

When the contact member 10*b* has a diameter of 3 mm, 3 to 20 projecting portions 40 are formed, preferably, 4 to 15 projecting portions 40 are formed, and more preferably, 6 to 12 projecting portions 40 are formed. The projecting portion 40 has preferably a substantially semi-spherical shape. In the projecting portions 40 formed in any of the numbers described above, some may fail to be shaped perfect. However, at least three projecting portions 40 should preferably be formed perfect in shape. The projecting portions 40 are desirably disposed to be aligned regularly while being spaced apart from one another at constant intervals on the whole of one surface of the rubber-like elastic body 11. As a form of disposing the projecting portions 40, the projecting portions 40 are preferably disposed in square or in a zigzag fashion. In the case where the projecting portions 40 are disposed regularly, when the contact member 10*b* is bonded to the lower projecting portion 6, the contact member 10*b* can easily be bonded horizontally to the lower projecting portion 6.

The diameter of a bottom area of the projecting portion 40 ranges preferably from 0.1 mm to 2.0 mm, more preferably from 0.2 mm to 1.0 mm, and much more preferably from 0.4 mm to 0.6 mm. The height of the projecting portion 40 ranges preferably from 0.01 mm to 1.0 mm, more preferably from 0.03 mm to 0.50 mm, and much more preferably from 0.05 mm to 0.15 mm. The affixation of contact members 10*b* to each other can be reduced more by setting the size of the projecting portion 40 to those described above.

3. Contact Member Production Method

Next, an example of a production process of the contact members 10, 10*a*, 10*b* (hereinafter, referred to as "10 or the like") described above will be described.

Figure 6:
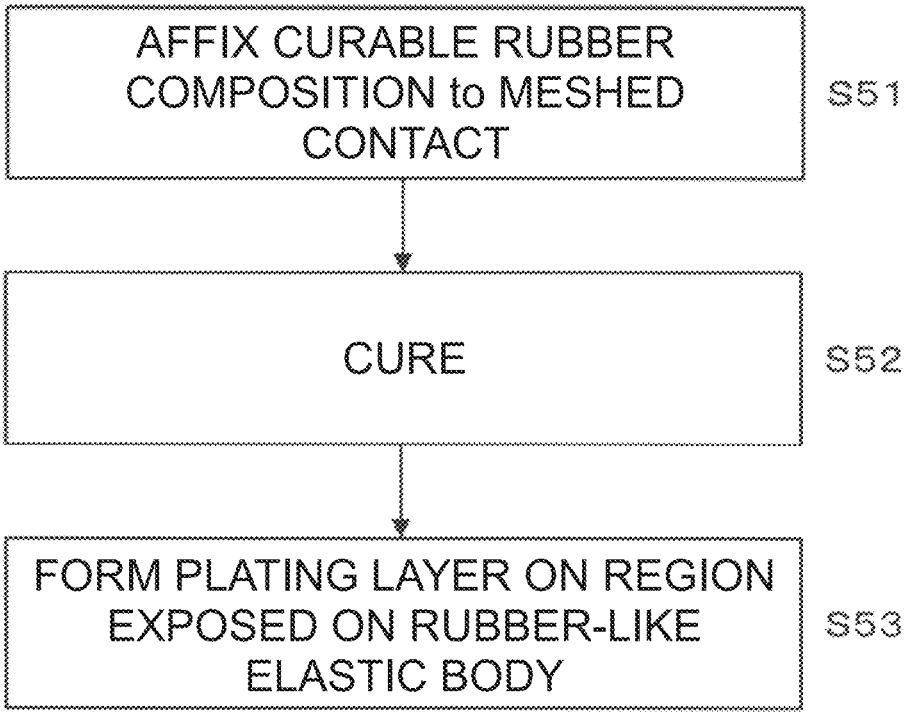
FIG. 6 illustrates a flow of one example of a contact member production method according to the resent invention.

FIG. 6 illustrates a flow of an example of a contact member production method according to the present invention.

A most typical approach to production of the contact member 10 or the like will be as follows. Firstly, a meshed contact 12 made up of one or more layers of a metal other than a noble metal is embedded in a curable rubber composition that is in a stage before a rubber-like elastic body 11 is cured completely in such a manner that the meshed contact 12 is exposed (a meshed contact portion embedding step: S51). Following the meshed contact portion embedding step (S51), the curable rubber composition is cured (a curing step: S52). The curing step may be executed a plurality of times. Next, a highly conductive metal plating layer 30 (an example of a coat layer) having a higher conductivity than that of the metal in an outermost surface of the meshed contact 12 is formed only on a region of the meshed contact 12 exposed from the rubber-like elastic body 11 (a coat layer forming step: S53). The plating layer 30 may be formed using any method.

Figure 7:
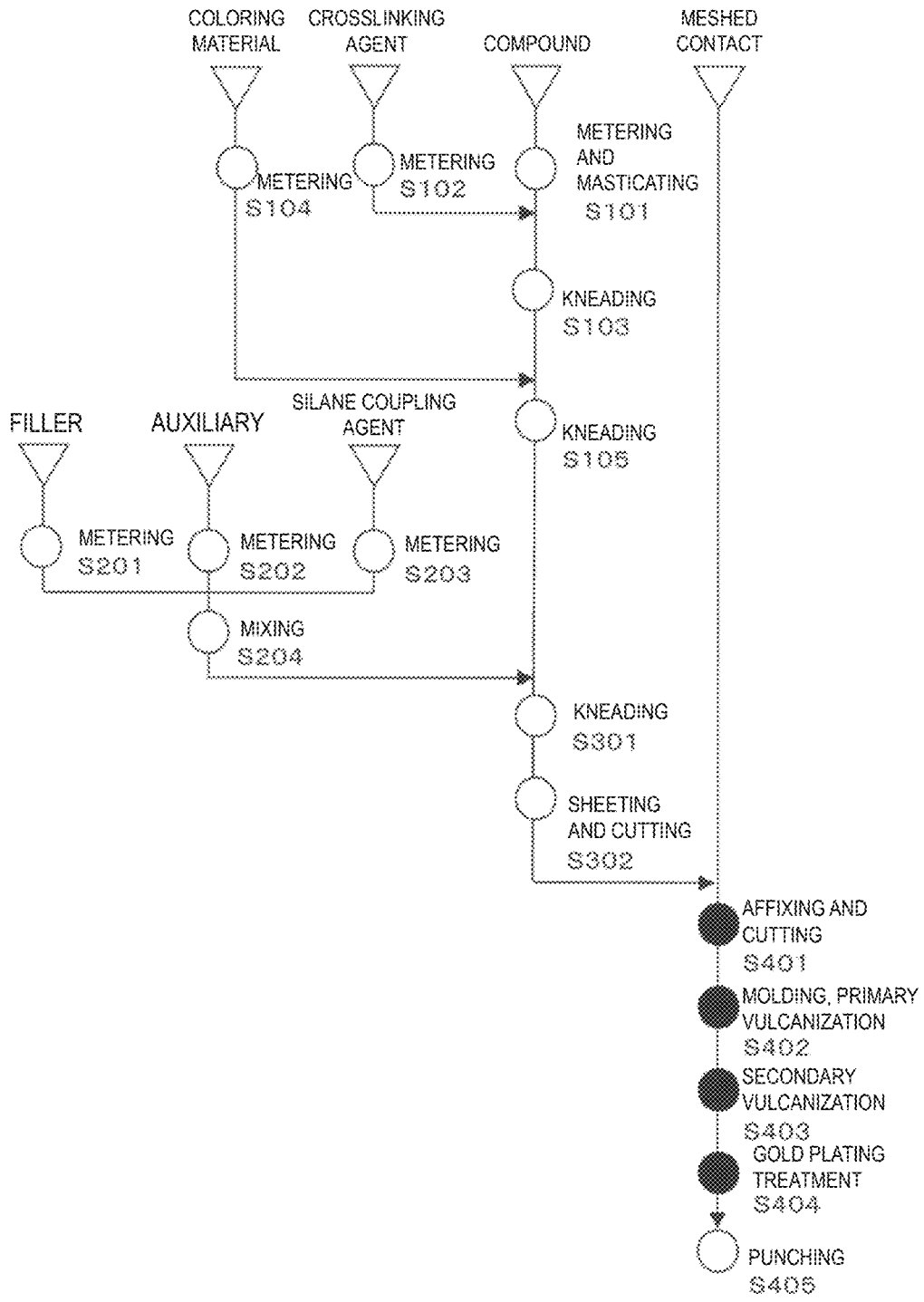
FIG. 7 illustrates a flow of one example of a preferred production method of the contact members of the embodiments of the present invention.

FIG. 7 illustrates a flow of an example of a preferred production method of the contact members according to the embodiments of the present invention. This flow will be described in greater detail than the flow illustrated in FIG. 6. In FIG. 7, steps indicated by black circles constitute important steps in the contact member production method.

Firstly, a compound such as silicone rubber is metered and masticated (S101). In parallel with this, a crosslinking agent is metered (S102). The metered crosslinking agent is kneaded with the masticated compound (S103). One type or two or more types of crosslinking agents may be used. A coloring material is metered (S104), and the coloring material is kneaded with the compound that has been processed accordingly in S103 (S105). Note that the coloring material includes, for example, pigment and/or dye.

A filler is metered (S201), an auxiliary is metered (S202), and a silane coupling is metered (S203). Then, the metered filler, auxiliary and silane coupling agent are mixed together (S204). The mixed filler, auxiliary and silane coupling agent are kneaded together with the compound that has been processed accordingly in S105 (S301). Note that filler, auxiliary and silane coupling agent are not essential, and at least one of them may be added. Following this, the compound that has been processed accordingly in S301 is formed into the shape of a sheet and is then cut in an appropriate size (S302).

Next, a meshed contact 12 is prepared, and the meshed contact 12 is affixed to the sheet-formed body and is cut (S401). Following this, the sheet-formed body to which the meshed contact 12 is affixed is placed in a mold for molding. In this molding, the mold is heated, so that the sheet-formed body in the mold is subjected to a primary vulcanization (S402). Next, the mold is opened, and a molded form removed from the mold is heated to be subjected to a secondary vulcanization (S403). Next, a plating treatment using gold or the like is applied to the meshed contact 12 exposed on a rubber-like elastic body 11 (S404). Finally, the rubber-like elastic body 11 with the plated meshed contact 12 is punched in a size of a diameter of about 3 mm, whereby contact members 10 or the like are completed (S405).

Figure 8:
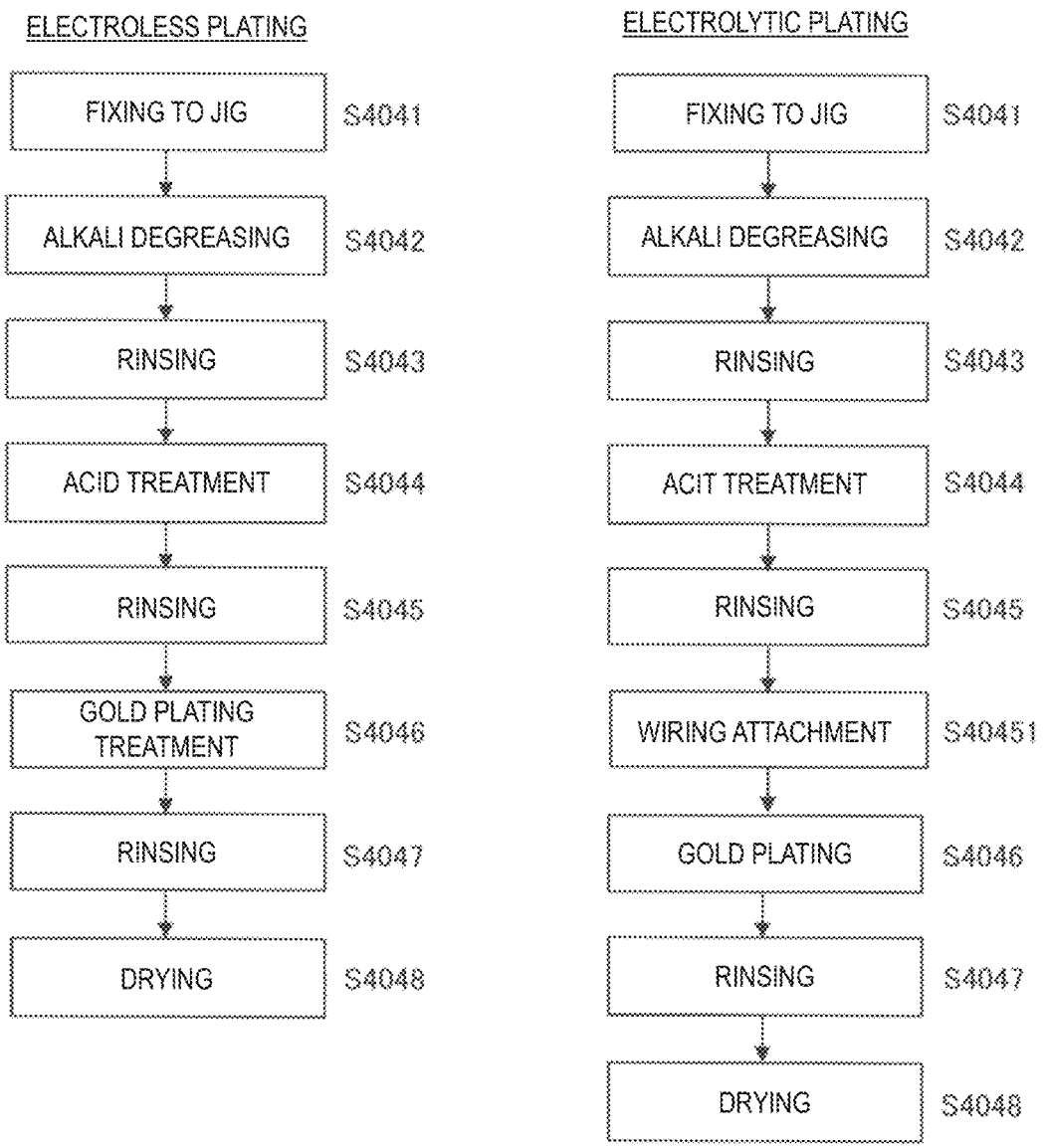
FIG. 8 illustrates flows of detailed processes of two main types (electroless plating and electrolytic plating) of the plating process in FIG. 7.

FIG. 8 illustrates flows of detailed process of the plating treatment in FIG. 7 based on two main types (electroless plating and electrolytic plating).

The plating treatment (S404) in FIG. 7 is roughly classified into electroless plating and electrolytic plating. In the case of electroless plating, a contact member 10 or the like to be subject to plating is fixed to a jig (S4041), and a surface preparation is performed on a surface to which a plating treatment is applied in the order of alkali decreasing (S4042), rinsing (S4043), acid treatment (S4044), and rinsing (S4045). Next, the contact member 10 or the like that is fixed to the jig is put in a plating bath, and a plating using gold or the like is applied thereto through electroless plating (S4046). Thereafter, the plated contact member 10 or the like is removed from the plating bath for rinsing (S4047) and drying (S4048), ending the electroless plating process. In the case of electroless plating, ions of the gold or the like in the plating bath receive electrons and deposit on a surface of the meshed contact 12. Note that alkali degreasing (S4042) may be replaced by acid degreasing. In the case of acid degreasing, a hydrogen ion index is not varied greatly, and hence, the rubber-like elastic body is affected little. For this reason, alkali degreasing can be regarded as superior degreasing (S4042) including acid degreasing.

For electrolytic plating, similar steps to those for electroless plating are executed except that a step of connecting wiring to the meshed contact 12 (S40451) is interposed between the rinsing (S4045) and the plating treatment (S4046). As with electroless plating, in the case of electrolytic plating, too, alkali degreasing (S4042) may be replaced by acid degreasing. In the case of electrolytic plating, metal wires 22, 23 of the meshed contact 12 function as electrodes, and ionization of the metal wires 22, 23 and deposition of gold or the like to the electrode are performed. Although as the plating layer 30 formed on the metal wires 22, 23 constituting the meshed contact 12, either of an electrolytic plating layer and an electroless plating layer will do, in selecting one of the two plating layers, the electrolytic plating layer is preferable. The reason that the electrolytic plating layer is preferable will be described as follows.

FIG. 9A to 9C illustrate comparisons between an electroless plating of gold and an electrolytic plating of gold in relation to production condition and performance, in which FIG. 9A illustrates a comparison in relation to production condition, FIG. 9B illustrates comparisons in relation to a contact force of a plating layer and a bonding force between a meshed contact and a rubber-like elastic body, and FIG. 9C illustrates a comparison in relation to a contact resistance value. In measuring a contact resistance, a comb teeth-like gold plated circuit board is used which has electrodes of which an electrode width is 0.5 mm, an electrode gap is 0.5 mm, and a thickness is a copper foil thickness of 35 μm+Ni plating thickness of 3 μm+Au plating thickness of 0.3 μm. In addition, in measuring a contact resistance value, an ADVANTEST R6561 DIGITAL MULTIETER is used as a measuring device under a load of 9 N. In FIG. 9C, values given in rows of Max., Min., and Av. are those obtained under a condition of N=12.

As shown in FIG. 9A, a temperature and a time or processing time of the electrolytic gold plating are about ½ and of the order of 1/10 of those of the electroless plating, respectively. It is considered from this that electrolytic plating is advantageous over electroless plating since the rubber-like elastic body 11 is damaged less and adhesiveness between the metal wires 22, 23 and the rubber-like elastic body 11 is affected less in electrolytic plating than in electroless plating. As shown in FIG. 9B, it is considered that electrolytic plating is superior to electroless plating in terms of both a contact force of the plating layer 30 and the bonding force between the meshed contact 12 and the rubber-like elastic body 11. As shown in FIG. 9C, in both electroless plating and electrolytic plating, it is recognized that the contact resistance is reduced effectively as a result of the plating layer 30 being formed, compared with a case where no plating layer is formed. When the respective contact resistances of electroless plating and electrolytic plating are compared, the contact resistances are almost the same, and no specific difference is recognized between them. It is considered generally from these facts that electrolytic plating is advantageous over electroless plating.

4. Other Embodiments

Thus, while the preferred embodiments of the present invention have been described heretofore, the present invention is not limited to the embodiments described above but can be carried out in various modified forms.

For example, the meshed contact 12 is not limited to the one made up of the metal wires 22, 23 in the two directions that intersect each other, and hence, a contact will do which is formed by interlacing metal wires using any method, provided that the resulting contact is a meshed one. Alternatively, a contact will do which is formed using any other method than the method of interlacing such metal wires. Although the plating layer 30 is preferably the electrolytic plating layer, an electroless plating layer will do. Although the projecting portion 40 is preferably the semi-spherical member having the curved surface, the projecting portion 40 is not limited to the member that is configured so. Hence, the projecting portion 40 may be, for example, a substantially rectangular parallelepiped projecting portion of which a distal end terminates into a flat surface. The projecting portion 40 may have a shape of circular cone. In addition, steps S402 to S403 in the flow of FIG. 7 may be replaced by the following steps. For example, in a step (S402*a*) following step S401, part of a wire mesh is embedded in the sheet-formed body through a lamination treatment using a pinch roll. Following this, the sheet-formed body with the wire mesh is introduced into a hot air dryer, and a primary vulcanization is performed thereon with no pressure applied (S402*b*). Then, a protection film (one-side removable treated PET) is peeled off (S402*c*), whereafter a secondary vulcanization is performed on the sheet-formed body (S403*a*). Thereafter, as with the flow illustrated in FIG. 7, a gold plating treatment is applied to the meshed contact 12 exposed on the rubber-like elastic body 11 (S404), and finally, the rubber-like elastic body 11 with the meshed contact 12 is punched in a size of a diameter of 3 mm (S405), thereby producing the contact member 10 or the like. Note that the coat layer may be a layer other than the plating layer 30 formed through plating, and hence, a layer will do which is formed through, for example, PVD, CVD, or various types of printing techniques.

EXAMPLE

Next, an example of the present invention will be described. However, the present invention is not limited to the following example.

(Production Method)

A crosslinking agent (Product No.: C-25A/B, produced by Shin-Etsu Chemical Co., Ltd.) containing 0.5 parts by mass an agent A and 2.0 parts by mass of an agent B and 1.0 parts by mass of a red coloring agent (Product No.: X-93-942 produced by Shin-Etsu Chemical Co., Ltd.) were metered individually and added together to 100 parts by mass of silicone rubber compound (Product No.: KE-9510-U produced by Shin-Etsu Chemical Co., Ltd.) for kneading. Further, 1.0 parts by mass of adhesion assistant (Product No.: X-93-3046 produced by Shin-Etsu Chemical Co., Ltd.) and 1.0 parts by mass of silane coupling agent (Product No.: KBM-403 produced by Shin-Etsu Chemical Co., Ltd.) were added to 0.1 parts by mass of silica (Product Name: AEROSIL200) for kneading. Next, the resulting kneaded substance was mixed into the kneaded substance of silicone rubber compound and was then distributed into a sheet-like form of a thickness of 0.5 mm, whereby material ribbons were prepared.

Next, a 0.08 mm diameter and 120 mesh wire mesh of nickel and a one-side removable treated PET of a thickness of 25 μm were prepared, and PET, material ribbon, wire mesh and PET were layered sequentially on one another in that order. Next, this layered sheet was placed in a mold including a flat upper mold and a lower mold provided with a plurality of recessed portions to provide corresponding projecting portions on a molded form, and a compression and heating molding was executed for four minutes at 125° C. (a primary vulcanization). The mold is opened after molding, and a secondary vulcanization was executed on a molded form with PET sheets on both sides removed for 60 minutes at 175° C. As a result, a sheet was obtained in which part of the wire mesh of nickel was embedded in one side of the silicone rubber and a plurality of projecting portions are formed on a surface of an opposite side. The sheet after the secondary vulcanization was subjected to gold plating with respect to the exposed metal portion by electrolytic plating. Finally, the sheet, to which the gold plating treatment was applied, was punched using a punching die of a diameter of 3 mm, whereby contact members of a diameter of 3 mm are completed.

The contact member prepared in the manner described above was placed in a mold prepared to mold a rubber key pad, and a silicone rubber producing material was supplied into the mold for molding. As a result, a push-button switch member was obtained which had a meshed contact at a contact portion.

(Evaluation)

(1) Keying Durability Test

The push-button switch member was fixed to a comb teeth-like gold plated circuit board having electrodes of which an electrode width was 0.5 mm, an electrode gap was 0.5 mm, and a thickness was a copper foil thickness of 35 μm+Ni plating thickness of 3 μm+Au plating thickness of 0.3 μm, and keying was performed up to 500,000 times under a load of 6 N/key and at a keying speed of three times per second, and when the number of times of keying reached a predetermined number of times of keying, a contact resistance value was measured using the ADVANTEST R6561 DIGITAL MULTIETER as a measuring. When the measured contact resistance values did not differ greatly from initial values, and a failure in external appearance such as dislocation of the metal wires was not recognized, the push-button switch member was recognized as being "acceptable".

TABLE 1

| | n1 | | n2 | |
|---|---|---|---|---|
| | Contact Resistance (Ω) | External Appearance | Contact Resistance (Ω) | External Appearance |
| Start | 0.369 | No Abnormality | 0.307 | No Abnormality |
| 50k times | 0.351 | — | 0.313 | — |
| 100k times | 0.335 | — | 0.306 | — |
| 200k times | 0.347 | — | 0.322 | — |
| 300k times | 0.374 | — | 0.326 | — |
| 500k times | 0.376 | No Abnormality | 0.324 | No Abnormality |

As shown in Table 1, no remarkable increase in contact resistance value was recognized in the keying test up to 500,000 times. Additionally, nothing abnormal was recognized in external appearance.

(2) High Temperature and High Humidity Durability Test

An environment test was carried out using a push-button switch member prepared under the production conditions described above. As a comparison, a push-button switch member having the contact member mounted thereto was used which was prepared without executing the step of applying a gold plating in the production method of the example. Contact resistance values were measured under a load of 9 N using the ADVANTEST R6561 DIGITAL MULTIETER as a measuring. Contact resistance values were measured using the comb teeth-like gold plated circuit board having electrodes of which an electrode width was 0.5 mm, an electrode gap was 0.5 mm, and a thickness was a copper foil thickness of 35 μm+Ni plating thickness of 3 μm+Au plating thickness of 0.3 μm. A high temperature and high humidity condition (room temperature of 65° C., room humidity of 95% RH, storage time of 500 hours) was adopted as environment condition. Then, contact resistance values were measured before the test (at the time of start), 240 hours (240H) later, and 500 hours (500H) later. In Table 2, values given in rows of Max., Min., and Av. are those obtained under a condition of N=12. In evaluating the results of the high temperature and high humidity durability test, when the measured contact resistance values did not differ greatly from initial values, and a failure in external appearance was not recognized (that is, neither a dislocation of the metal wires nor a remarkable generation of corrosion product was recognized), the push-button switch member was recognized as being "acceptable".

TABLE 2

| | Start | | 240H | | 500H | |
|---|---|---|---|---|---|---|
| Contact Resistance (Ω) | No Gold Plating | Example | No Gold Plating | Example | No Gold Plating | Example |
| Maximum | 0.283 | 0.222 | 0.326 | 0.220 | 0.336 | 0.229 |
| Minimum | 0.271 | 0.210 | 0.291 | 0.209 | 0.324 | 0.213 |
| Average | 0.278 | 0.215 | 0.310 | 0.213 | 0.331 | 0.219 |

As shown in Table 2, a reduction in contact resistance value due to application of the gold plating was recognized, and it was recognized that an increase in contact resistance value was suppressed even under the high temperature and high humidity condition. Additionally, nothing abnormal in external appearance was recognized.

INDUSTRIAL APPLICABILITY

The present invention can be applied to a device including a push-button switch.

The invention claimed is:

1. A contact member comprising:

a meshed contact comprising one or more layers of a metal other than a noble metal, the meshed contact being embedded in one surface of a rubber-like elastic body in such a manner as to have a region partially exposed from the one surface while the rest of the meshed contact is entirely buried in the rubber-like elastic body, wherein a highly conductive metal coat layer having a higher conductivity than that of the metal in an outermost surface of the meshed contact is provided only on the region of the meshed contact partially exposed from the one surface of the rubber-like elastic body.

2. The contact member of claim 1, wherein the meshed contact is a wire mesh comprising a plurality of metal wires intersecting each other, and wherein the region of the meshed contact comprises the plurality of metal wires exposed from the one surface of the rubber-like elastic body at least in one direction.

3. The contact member of claim 2, wherein the plurality of the metal wires is interlaced in a first direction and a second direction different from the first direction, wherein the region of the meshed contact comprises both of the plurality of metal wires in the first direction and the second direction partially exposed from the one surface of the rubber-like elastic body, and wherein a first area of the plurality of metal wires covered with the highly conductive metal coat layer in the first direction is larger than a second area of the plurality of metal wires covered with the highly conductive metal coat layer in the second direction.

4. The contact member of claim 2, wherein the wire mesh comprising the plurality of metal wires interlaced in a first direction and a second direction different from the first direction, wherein the region of the meshed contact comprises both of the plurality of metal wires in the first direction and the second direction partially exposed from the one surface of the rubber-like elastic body at a plurality of points, and wherein a first number of points where metal wires of the plurality of metal wires in the first direction are exposed from the rubber-like elastic body is greater than a second number of points where the metal wires of the plurality of metal wires are exposed from the rubber-like elastic body in the second direction.

5. The contact member of claim 2, wherein the wire mesh comprising the plurality of metal wires interlaced in a first direction and a second direction different from the first direction, wherein the region of the meshed contact comprises both of the plurality of metal wires in the first direction and the second direction partially exposed from the one surface of the rubber-like elastic body at a plurality of points, and wherein a height in which the plurality of metal wires are exposed from the one surface of the rubber-like elastic body is smaller than a diameter of the plurality of metal wires.

6. The contact member of claim 1, wherein the highly conductive metal coat layer is an electrolytic plating layer.

7. The contact member of claim 1, wherein one or a plurality of projecting portions are provided on another side of the rubber-like elastic body opposite to the one surface.

8. The contact member of claim 7, wherein a surface of each of the projecting portions is a curved surface.

9. A contact member production method for producing the contact member of claim 1, comprising:

a meshed contact portion embedding step of embedding a meshed contact comprising one or more layers of a metal other than a noble metal in a curable rubber composition that is in a stage before a rubber-like elastic body is cured completely in such a manner that the meshed contact has a region partially exposed from a one surface of the rubber-like elastic body while the rest of the meshed contact is entirely buried in the rubber-like elastic body;

a curing step of curing the curable rubber composition following the meshed contact portion embedding step; and a plating layer forming step of forming a highly conductive metal coat layer having a higher conductivity than that of the metal in an outermost surface of the meshed contact only on a region of the meshed contact is exposed from the rubber-like elastic body.

10. A push-button switch member comprising the contact member of claim 1.

11. A contact member comprising:

a rubber-like elastic body;

a meshed contact comprises a metal other than a noble metal and partially embedded in the rubber-like elastic body; and a highly conductive metal coat layer, wherein the mesh contact has regions partially exposed from one surface while the rest of the meshed contact is entirely buried in the rubber-like elastic body, the highly conductive metal coat layer is on the regions of the meshed contact exposed from the one surface of the rubber-like elastic body and has a higher conductivity than that of the metal in an outermost surface of the meshed contact.

12. The contact member of claim 5, wherein the height in which the plurality of metal wires is exposed from the one surface of the rubber-like elastic body in the first direction is smaller than that of in the second direction.

13. The contact member of claim 12, wherein an exposed portion of the plurality of metal wires is 0% to 0.5% in the diameter of the plurality of metal wires in the first direction.

14. The contact member of claim 12, wherein an exposed portion of the plurality of metal wires is 0.05% to 0.8% in the diameter of the plurality of metal wires in the second direction.

* * * * *